US006116246A

United States Patent [19]

Glenn et al.

[11] Patent Number: 6,116,246

[45] Date of Patent: Sep. 12, 2000

[54] SMOKELESS ASHTRAY

[75] Inventors: Neville R. Glenn; Robert VannRox, both of Milford; Robert Barker, Lunenburg, all of Mass.

[73] Assignee: Holmes Products Corp., Milford, Mass.

[21] Appl. No.: 09/032,102

[22] Filed: Feb. 27, 1998

[51] Int. Cl.[7] ..... A24F 19/00; A24F 19/10

[52] U.S. Cl. ..... 131/238; 131/231

[58] Field of Search ..... 131/231, 238

[56] References Cited

U.S. PATENT DOCUMENTS

| | | |
|---|---|---|
| 3,516,232 | 6/1970 | Gilbertson . |
| 3,807,148 | 4/1974 | Fike et al. . |
| 3,958,965 | 5/1976 | Raczkowski . |
| 4,043,776 | 8/1977 | Orel . |
| 4,119,419 | 10/1978 | Passaro et al. . |
| 4,154,251 | 5/1979 | Doyel . |
| 4,177,045 | 12/1979 | Orel . |
| 4,580,582 | 4/1986 | Grube et al. . |
| 4,671,300 | 6/1987 | Grube et al. . |
| 4,828,165 | 5/1989 | Watai et al. . |
| 4,883,224 | 11/1989 | Sun . |
| 4,996,995 | 3/1991 | Kojima . |
| 5,259,400 | 11/1993 | Bruno et al. . |
| 5,325,876 | 7/1994 | Yang . |
| 5,591,242 | 1/1997 | Kuo . |

*Primary Examiner*—Christopher A. Fiorilla
*Attorney, Agent, or Firm*—Hoffmann & Baron, LLP; Francis E. Marino

[57] ABSTRACT

A smokeless ashtray includes an ashtray that is formed with an ash receiving cavity and air passageway. The ashtray is supported by a housing having an upper portion which forms an air intake substantially adjacent to the ash receiving cavity, and a bottom portion which removably receives the ashtray. The bottom portion also includes a motor filter receiving space and is formed with an exhaust aperture. A motor is mounted within the motor filter receiving space with a fan being connected thereto such that the fan is located below the ashtray. The smokeless ashtray also includes an ashtray filter and/or a motor filter. The air passageway of the ashtray is configured to receive the ashtray filter while the motor filter receiving space within bottom portion of the housing is configured to receive the motor filter. The fan creates an air flow by drawing smoke-filled air into the air intake down through the air passageway and out through the exhaust aperture with at least one of the ashtray filter and the motor filter being located within the air flow to remove smoke and impurities therefrom.

7 Claims, 4 Drawing Sheets

SMOKELESS ASHTRAY

BACKGROUND OF THE INVENTION

1. Field of the Invention

The present invention relates generally to an ashtray and more particularly to an ashtray wherein cigarette and cigar smoke is drawn through a filter material to remove the smoke and impurities from the air.

2. Description of the Prior Art

Smokeless ashtrays are well-known devices and currently there are many types that are commercially available.

One style of a smokeless ashtray is disclosed in U.S. Pat. Nos. 4,154,251 and 4,177,045 to Doyel and Orel respectively. The Doyel '251 and Orel '054 patents disclose smokeless ashtrays that include a conventional ashtray that is partially surrounded by a shroud for confining smoke. The shroud supports a motorized fan, batteries and filter element, all of which are located above the ashtray. Although it is advantageous to draw in the smoke from above as cigarette and cigar smoke rises, a common disadvantage of both of these smokeless ashtrays is that the center of gravity of the devices are located above the ashtray making the devices more susceptible to being accidentally knocked over.

Another style of a smokeless ashtray is disclosed in U.S. Pat. No. 4,671,300 to Grube et al. The Grube et al. '300 patent discloses a smokeless ashtray having a housing, a battery-driven fan mechanism and an air filter. The housing has an upper portion forming an ash collection cavity that includes openings for drawing off the smoke in a downward manner. The fan mechanism and filter elements are both located within the housing below the ash collection cavity. The air filter is substantially square in shape and has an opening in the center thereof dimensioned for positioning around the motor included in the battery-driven fan mechanism. A disadvantage of this type of ashtray is that since the air filter element is located within the housing, a substantial portion of the interior structure becomes coated with tar and nicotine, and the housing must first be disassembled to change the filter. This process is messy as the exposed interior structure is coated with tar and nicotine and the air filter must be extracted from its position around the motor while also being saturated with tar and nicotine.

Another style of a smokeless ashtray is disclosed in U.S. Pat. No. 5,259,400 to Bruno et al. The Bruno '400 patent discloses a smokeless ashtray that has a base 22 with a lid 20 hinged thereto. The filter 46 is located in the lid and the lid includes an air duct 70 for communicating with a battery driven fan mechanism located within the base. The fan mechanism is located below a dish-shaped member 40 that collects the ashes. When the lid is opened, the fan is turned on. The lid also includes a perforated dome-like member 58 for securing the filter to the lid. As shown in FIG. 6, the filter 46 lays against the inside surface of the lid 20 forming a gap between the filter and the inside of the dome-like member 58, and the air intake formed by the dome-like member 58 is substantially set back from the rim 59 of the dish-shaped member 40. The Bruno patent also discloses that it is configured to receive the same style filter as disclosed in the Grube '300 patent which is square in shape and includes an opening in the center thereof for positioning around the motor within the base.

The lid assembly of the Bruno reference has several disadvantages. First, the location of the filter 46 adjacent to the inside surface of the lid member 20 is inefficient. More specifically, the top portion of the filter element generally will not act in filtering smoke and impurities since the air that is drawn through the duct wall 70 will travel through a path of least resistance. That is, the smoke that enters the top portion of the dome-like member 58 will travel down the gap between the filter 20 and dome-like member 58 before entering the air duct 70. It is preferable to have a filter element arranged so that smoke will pass through the filter in a path that is substantially perpendicular to the plane of the filter. Second, the air intake at the dome-like member 58 is substantially set back from the dish-shaped member 40 which is undesirable in attempting to capture the smoke emanating from cigarettes or cigars. Third, because smoke encounters the dome-like member 58 prior to being filtered, the dome-like member's surfaces generally get covered with tar and nicotine making it an unpleasant task to replace the filter. Lastly, as shown in FIG. 5, the dome-like structure 58 reduces the holding capacity of the dish-shaped member 40 for the storage of ashes and butts.

OBJECTS AND SUMMARY OF THE INVENTION

It is an object of the present invention to provide a smokeless ashtray that uniformly accepts all commercially available filter elements.

It is another object of the present invention to provide a smokeless ashtray that allows for the easy replacement of the air filters.

It is yet another object of the present invention to provide a smokeless ashtray that filters the smoke out of the air prior to the air's contact with filter securing parts and the internal cavities and parts of the housing.

It is yet another object of the present invention to provide a smokeless ashtray that has a center of gravity that is below the ash receiving cavity and provides for the intake of smoke fumes above the rim of the ash receiving cavity while being substantially adjacent to and extending over the ash receiving cavity.

It is yet another object of the present invention to provide a cover for the ash receiving cavity to contain the odors of the ashes and butts, but does not interfere with the capacity of the ash receiving cavity.

In accordance with one form of the present invention, a smokeless ashtray includes an ashtray that is formed with an ash receiving cavity and air passageway. The ashtray is supported by a housing having an upper portion which forms an air intake substantially adjacent to the ash receiving cavity, and a bottom portion which removably receives the ashtray. The bottom portion also includes a motor filter receiving space and is formed with an exhaust aperture. A motor is mounted within the motor filter receiving space with a fan being connected thereto such that the fan is located below the ashtray. The smokeless ashtray also includes an ashtray filter and/or a motor filter. The air passageway of the ashtray is configured to receive the ashtray filter while the motor filter receiving space within bottom portion of the housing is configured to receive the motor filter. The fan creates an air flow by drawing smoke-filled into the air intake down through the air passageway and out through the exhaust aperture with at least one of the ashtray filter and the motor filter being located within the air flow to remove smoke and impurities therefrom.

In a preferred embodiment of the invention the smokeless ashtray also includes a cover for reducing odors, and the upper portion of the housing forming the air intake is extended partially over the ash receiving cavity of the ashtray to maximize the amount of smoke that is recovered from burning cigarettes or cigars. The smokeless ashtray may also include a base for supporting the bottom portion of the housing.

The smokeless ashtray also includes a power control unit for controlling the motor. The power control unit has an ashtray contact, cover contact, and contact assembly all of which are electrically conductive and mounted within the bottom portion of the housing. The contact assembly has first and second legs. The cover of the smokeless ashtray is pivotally connected by a set of pivot pins, with one pivot pin including a pawl. The ashtray is provided with a tab for engaging the first leg of the contact assembly to displace the first leg so that the first leg makes electrical contact with the ashtray contact. When the cover is opened, the pawl rotates displacing the cover contact so that the cover contact electrically engages the second leg of the contact assembly. Accordingly, the motor only operates when both the ashtray is seated in the bottom portion of the housing and the cover is in an opened position.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
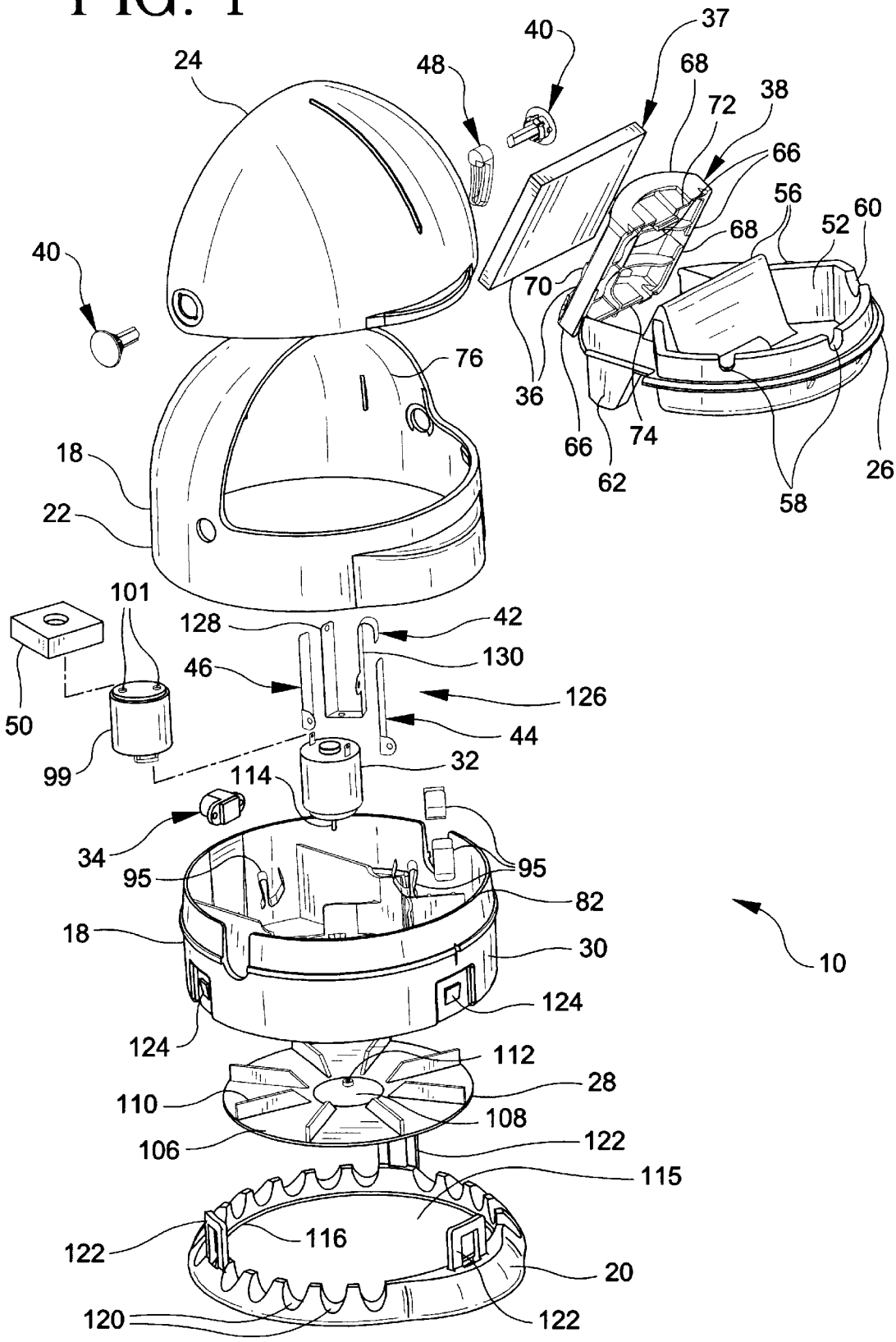
FIG. 1 is an exploded perspective view of a smokeless ashtray according to the present invention.

Referring to FIG. 1, the smokeless ashtray 10 generally includes an ashtray 26, a housing 18, a motor 32, a fan 28, and an air cleaning element. The air cleaning element may be either an ashtray filter 36 and/or a motor filter 50. The smokeless ashtray 10 also preferably includes a base 20 and a cover 24.

The ashtray filter 36 has a frame 38 which is generally rectangular in shape and includes a filter material 37 mounted thereon. The filter frame 38 includes a plurality of longitudinal frame members 66 that are parallel to the legs 62 that define the air passageway 54, and a plurality of transverse members 68 that are substantially perpendicular to the frame members 66. In the preferred embodiment as shown in FIG. 1, the transverse members 68 are curved. The filter frame 38 includes a plurality of filter-tabs 70 for securing the filter material 37 along its perimeter to the filter frame 38. The filter frame 38 also includes upper and lower locking tabs 72, 74 for removably connecting the filter frame 38 to the air passageway 54 of the ashtray. The upper locking tab 72 is flexible and engages the ashtray 26 below the rim 56 while the lower locking tab 74 is substantially rigid and engages the cross bar 64. To install the filter frame 38 within the air passageway 54, the lower locking tab 74 is initially inserted to engage the cross bar 64, and then the upper locking tab 72 is snapped into place below the rim 56 of the ashtray 26. This process is simply reversed to effectuate the removal of the filter frame 38. The addition of the filter frame allows for easier handling of the ashtray filter 36 when replacing.

Preferably, the ashtray filter material 37 comprises two layers. The first layer is made out of polypropylene material, e.g., fiber or foam and coated with activated carbon. The second layer is made out of electrostatically charged polypropylene fiber. It has been found that the combination of the first layer coated with activated charcoal and the second layer electrostatically charged is advantageous in filtering smoke and impurities from the air.

The motor filter 50 may be any commercially available filter, such as those illustrated and described in both the Grube et al. '300 and the Bruno et al. '400 patents. The motor filters described in the aforementioned references are substantially square in shape and have an opening that is substantially circular in the center thereof dimensioned for positioning around the motor 32. The motor filter 50 may also be substantially round in shape and have an opening that is substantially circular in the center thereof dimensioned for positioning around the motor 32.

Figure 2:
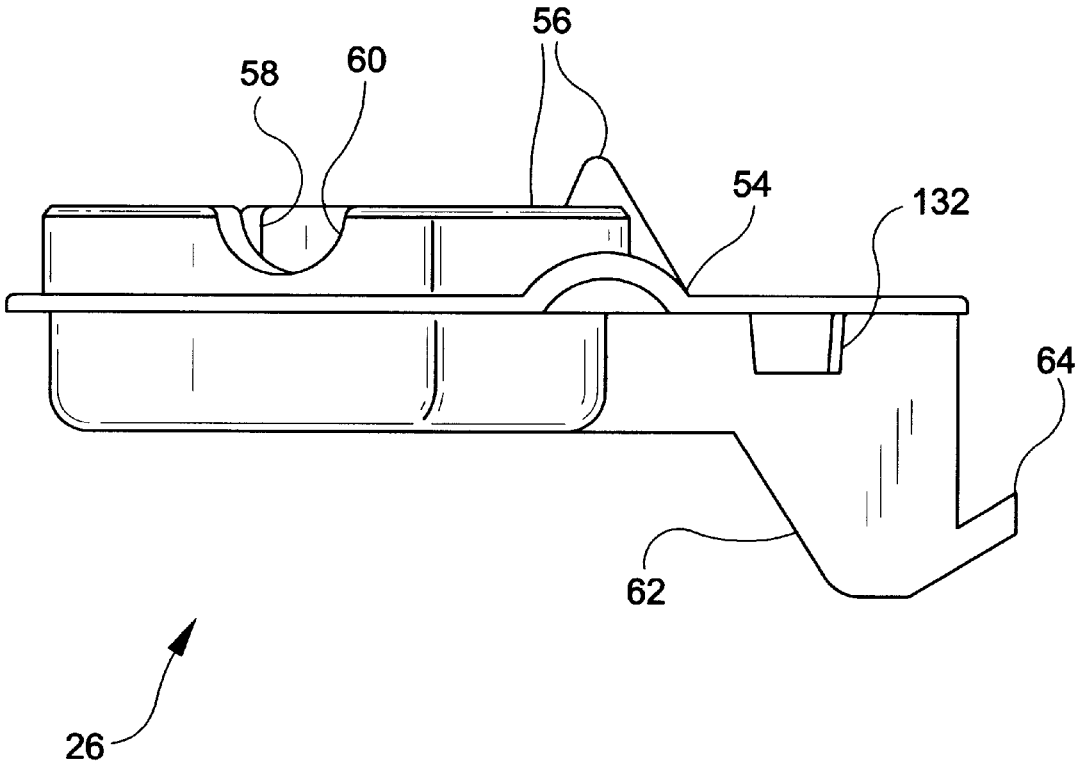
FIG. 2 is a side elevational view of the ashtray.

Referring to FIGS. 1 and 2, the ashtray 26 is formed with an ash receiving cavity 52 and an air passageway 54. The ash receiving cavity 52 has a rim 56 that is formed with cigarette and cigar notches 58, 60, which are of different sizes, used for supporting a cigarette, or a cigar, respectively. The ash receiving cavity 52 catches and contains the ashes from such cigarettes and cigars. The air passageway 54 is defined by the rim 56 of the ash receiving cavity 52, a pair of parallel legs 62 extending from the rim 56 and a cross bar 64 extending between the parallel legs 62. The air passageway 54 is configured to closely receive the ashtray filter 36. Preferably, the air passageway 54 is configured so that the ashtray filter 36 is substantially centrally located within the air intake 76. This ensures that the ashtray filter 36 will receive the smoke filled air uniformly and thus will wear evenly prolonging the life of the ashtray filter 36.

The motor 32 is an electric motor that is powered by DC current. A suitable motor 32 for use in the smokeless ashtray 10 is manufactured by Mabuchi Motor, Model No. RE-260-RA-18130. The motor 32 may be powered by either batteries or other suitable power sources. For example, a transformer for converting standard 110 AC current to a suitable DC voltage, such as 3V, 6V, 9V etc. may be used. As shown in FIG. 1, the preferred embodiment of the smokeless ashtray 10 includes an AC adapter connector 34 for this purpose. Of course, the smokeless ashtray 10 could be outfitted with a motor 32 that uses AC current as well.

Figure 4:
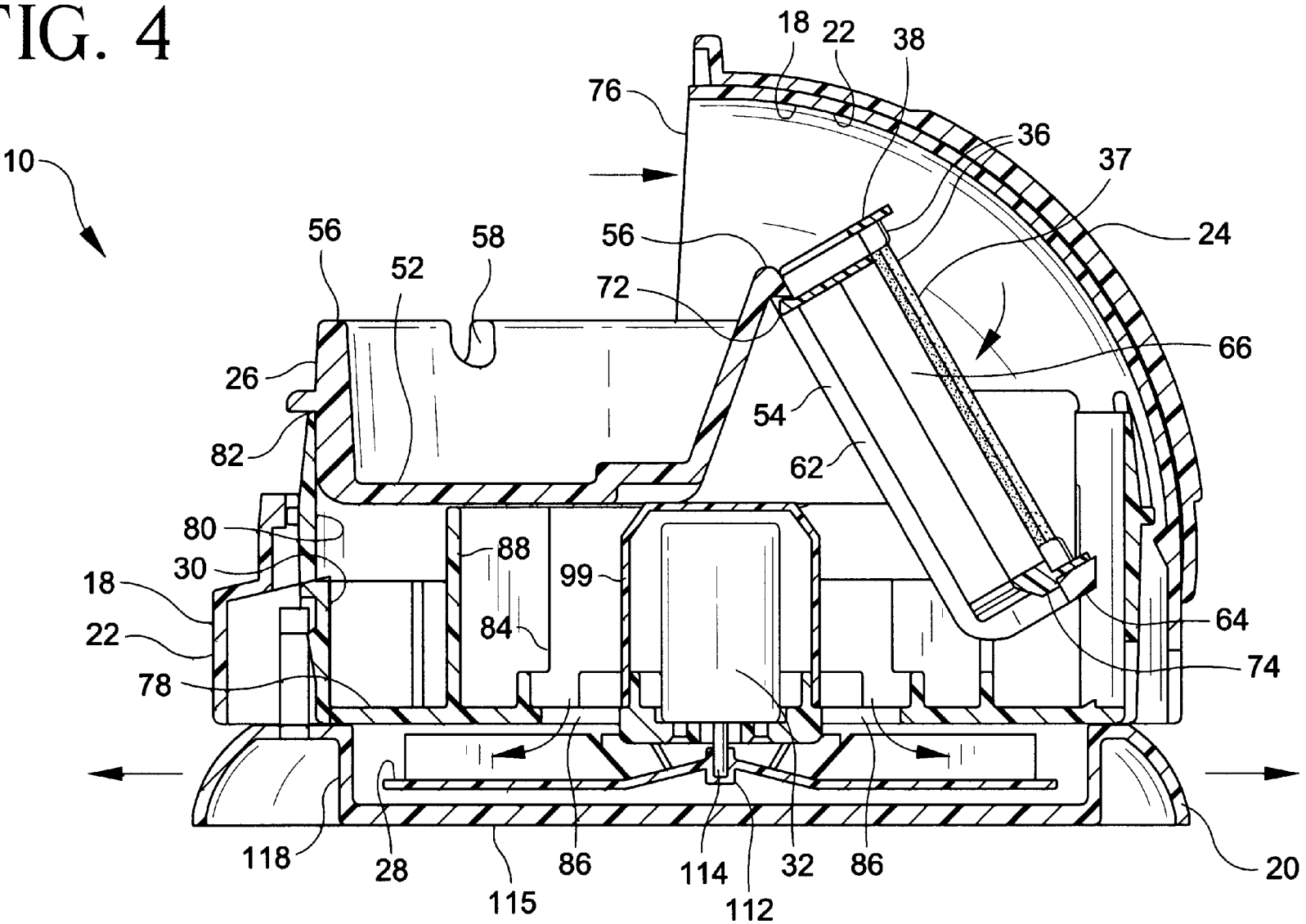
FIG. 4 is a cross-sectional view of the smokeless ashtray according to the present invention with the cover in the open position.

The housing 18 has an upper and bottom portions 22, 30. In manufacturing, the housing 18 may be either formed as two separate mating parts as shown in FIG. 1, or as one integral component part. The upper portion 22 forms an air intake 76 that is both substantially adjacent to the ash receiving cavity 52 and extends above the rim 56 of the ashtray 26. Preferably, the air intake 76 extends partially over the ash receiving cavity 52 as shown in FIG. 4 to maximize the amount of smoke that is recovered from burning cigarettes or cigars.

Figure 3:
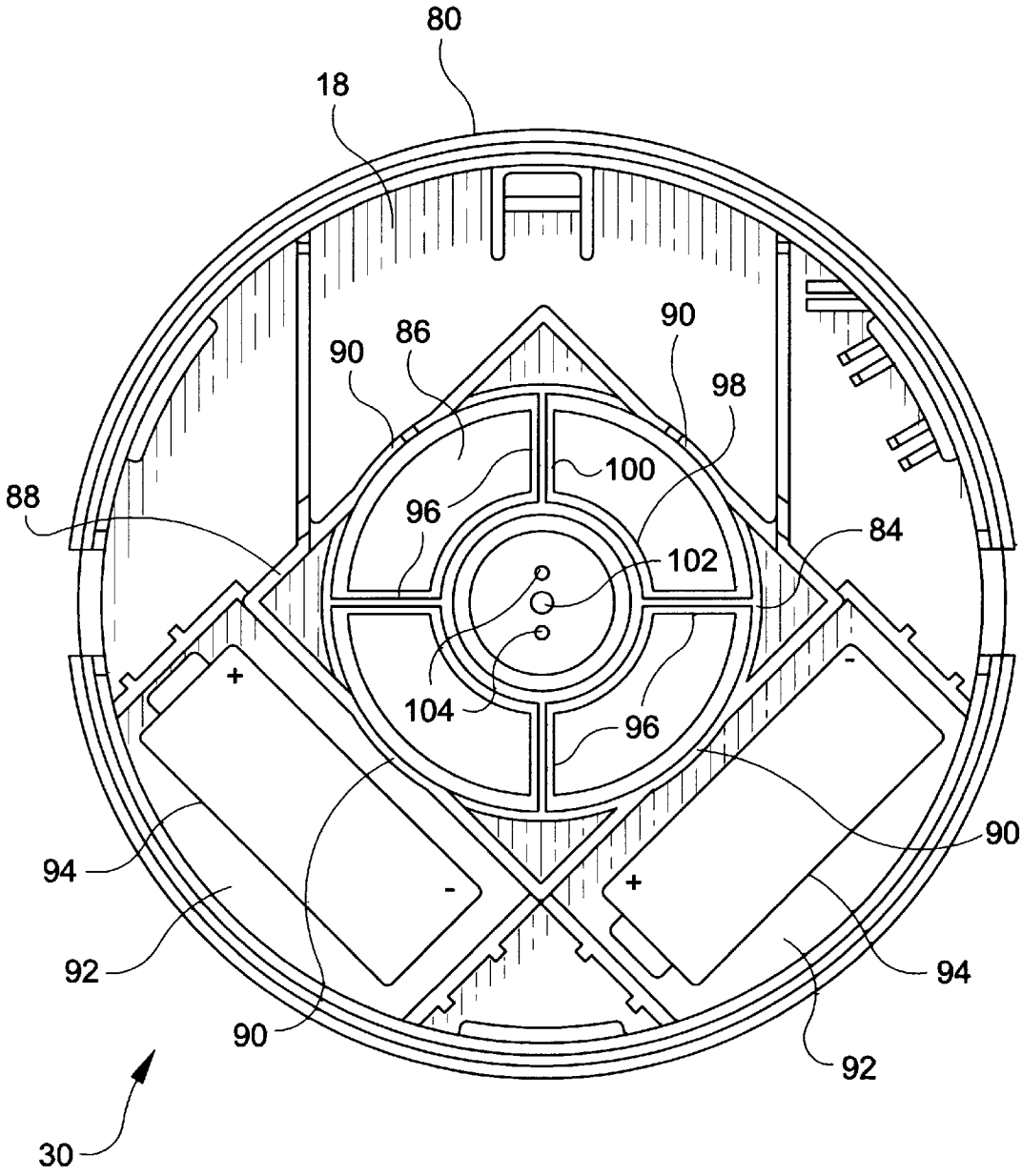
FIG. 3 is a plan view of the bottom portion of the housing.

The bottom portion 30 of the housing 18 has a bottom plate 78 with an outer wall 80 extending upwards from the perimeter of the bottom plate 78. The outer wall 80 has a top edge 82 for removably receiving the ashtray 26. The bottom portion 30 also includes a motor filter receiving space 84 and is formed with an exhaust aperture 86. As shown in FIG. 3, the exhaust aperture 86 is substantially centrally located within the bottom plate 78. The motor filter receiving space 84 is defined by a motor filter wall 88 which is substantially square in shape to accommodate a square motor filter 50. The motor filter wall 88 also includes curved portions 90 to accommodate motor filters 50 which are circular in shape. Two sides of the motor filter wall 88 are shortened to accommodate the parallel legs 62 of the ashtray 26, and a corner defined by the shortened sides is stepped down further to allow the air that is being drawn through the smokeless ashtray 10 to pass from the air passageway 54 towards the exhaust aperture 86. The bottom portion of the housing also includes a plurality of battery receiving spaces 92 that include battery contacts 95 for accommodating batteries 94 to power the motor 32. Preferably, the housing 18 is configured to ensure that the center of gravity of the smokeless ashtray 10 is below the ashtray 26. This is advantageous as this reduces the likelihood that the smokeless astray 10 will be accidentally knocked over.

The motor 32 is mounted within the bottom portion 30 of the housing 18. Preferably, the motor 32 is mounted within the center of the exhaust aperture 86. As shown in FIG. 3, a plurality of ribs 96 extend across the exhaust aperture 86 for supporting a motor mount plate 98 which is centrally located within the exhaust aperture 86. Preferably, the ribs 96 are T-shaped, but with at least one of the ribs 96 being channeled 100 to accommodate and protect the wires that run to the motor 32. The motor mount plate 98 is formed with a hole 102 to allow the motor shaft 114 to pass through to connect to the fan 28 which is attached thereto. Preferably, the motor mount plate 98 includes motor mounting holes 104 so that the motor may be connected to motor mount plate 98 by fasteners, e.g. screws. The motor 32 may also be covered with a motor cap 99 to protect the motor 32. The motor cap 99 includes a plurality of vent holes 101.

Referring now to FIG. 1, the fan 28 generally comprises a circular plate 106 that is substantially flat but having a raised portion 108 at its center with a plurality of trapezoidal shaped blades 110 extending from the center of the plate and being connected perpendicular to the plane of the circular plate 106. At the center of the fan 28 there is a shaft receiving sleeve 112 for connecting to the motor shaft 114. Preferably, the plate thickness at the shaft receiving sleeve 112 is thickened to strengthen the connection between the fan 28 and the motor 32. Referring now to FIG. 4, when the motor 32 is activated the fan 28 creates an air flow by drawing smoke-filled air first into the air intake 76 and then down through the air passageway 54 and subsequently out through the exhaust aperture 86. The smoke and impurities are removed by the air cleaning element 36, 50 located within the airflow. The air cleaning element may be either the ashtray filter 36 located within the air passageway 54 or the motor filter 50 which sits in the motor filter receiving space 84. Alternatively, the smokeless ashtray 10 may be operated with both an ashtray filter 36 and motor filter 50 being installed at the same time.

In a preferred embodiment of the present invention, the smokeless ashtray 10 also includes a cover 24. The cover 24 is pivotally connected to the upper portion 22 of the housing 18 and is dimensioned to enclose the air intake 76 formed in the upper portion 22 of the housing 18. The cover 24 conceals odors emanating from the smokeless ashtray 10 when not in use.

Preferably, the smokeless ashtray 10 also includes a base 20. The base 20 generally includes a lower plate member 115 defined by a perimeter 116 with a support wall 118 extending from the perimeter 116. The support wall 118 is configured to allow the bottom portion 30 of the housing 18 to rest on top of the support wall 118. The support wall 118 includes a plurality of openings 120 to allow the air that passes through the exhaust aperture 86 to escape through the openings 120. The support wall 118 is also formed with a plurality of latches 122 that engage the bottom portion 30 of the housing 18. As shown in FIG. 1, when a base 20 is provided, the bottom portion 30 of the housing 18 is formed with a plurality of keys 124 to receive the latches 122 in a mating connection. The base 20 encloses the fan 28 to protect persons against the movement of the fan 28. As shown in FIG. 4, the base 20 may also serve to support the housing 18 above whatever the smokeless ashtray 10 is sitting on in order to allow the fan 28 to rotate. Alternatively, the bottom portion 30 of the housing 18 could be configured to support the fan 28 so that it would be free to rotate without the need for a base 20.

The smokeless ashtray 10 further includes a power control unit 126 for controlling the motor 32. The power control unit 126 has an ashtray contact 46, cover contact 44, and contact assembly 42 all of which are electrically conductive and mounted within the bottom portion 30 of the housing 18 to the bottom plate 78. As shown in FIG. 1, the contact assembly 42 is substantially U-shaped and has a first and second legs 128, 130. The cover 24 of the smokeless ashtray 10 is pivotally connected by a set of pivot pins 40, one of which includes a pawl 48. The pawl 48 is connected to the pivot pin 40 such that the pawl 48 is located within the upper portion 22 of the housing 18. As shown in FIG. 2, the ashtray 26 is provided with a tab 132 for engaging the first leg 128 of the contact assembly 42 to displace the first leg 128 so that the first leg 128 makes electrical contact with the ashtray contact 46. When the cover 24 is opened, the pawl 48 rotates displacing the cover contact 46 so that the cover contact 46 electrically engages the second leg 130 of the contact assembly 42. Accordingly, the motor 32 only operates when both the ashtray 26 is seated in the bottom portion 30 of the housing 18 and the cover 24 is in an opened position.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. A smokeless ashtray for removing smoke and impurities from an airflow comprising:

an ashtray filter;

an ashtray including an ash receiving cavity and an air passageway, said air passageway being configured to receive said ashtray filter;

a housing having an upper portion, said upper portion forming an air intake substantially adjacent to said ash receiving cavity and a bottom portion for removably receiving said ashtray, said bottom portion being formed with an exhaust aperture;

a motor mounted within said bottom portion of said housing; and a fan connected to said motor and being located below said ashtray, wherein said fan creates an airflow by drawing smoke-filled air into said air intake down through said ashtray filter and out through said exhaust aperture thereby removing smoke and impurities therefrom.

2. A smokeless ashtray as defined in claim 1, further comprising a cover pivotally attached to the housing for reducing odors emanating from said ashtray when said cover is closed.

3. A smokeless ashtray as defined in claim 2, further comprising a power control unit for controlling said motor including:

an ashtray contact mounted within said frame;

a cover contact mounted within said frame;

a contact assembly having a first and second legs being substantially U-shaped and mounted within said frame;

a pivot pin for rotatably connecting said cover to said upper portion of said housing; and a pawl being located within said upper portion of said housing and connected to said pivot pin, wherein said ashtray is configured to engage said first leg when said ashtray is mounted on said frame so that said first leg electrically contacts said ashtray contact; and when said cover is opened said pawl displaces said cover contact so that said cover contact electrically contacts said second leg thereby turning said motor on.

4. A smokeless ashtray as defined in claim 1, wherein said ashtray filter comprises:

a filter frame; and a filter material mounted on said filter frame and having a first layer of polypropylene material coated with activated carbon and a second layer of electrostatically charged polypropylene fiber.

5. A smokeless ashtray as defined in claim 1, wherein said ashtray filter is substantially centrally located within said air intake.

6. A smokeless ashtray as defined in claim 1, having a center of gravity below said ashtray.

7. A smokeless ashtray as defined in claim 1, further comprising a base for supporting said bottom portion of said housing including:

a lower plate defined by a perimeter; and a support wall extending from said perimeter to form a mating connection with said bottom portion of said housing and being formed with a plurality of openings to allow the airflow that passes through said exhaust aperture to escape.

* * * * *